United States Patent [19]

Blum

[11] Patent Number: 4,724,634

[45] Date of Patent: Feb. 16, 1988

[54] SECURITY WINDOWS

[76] Inventor: Alvin S. Blum, 2350 Del Mar Pl., Fort Lauderdale, Fla. 33301

[21] Appl. No.: 9,220

[22] Filed: Jan. 30, 1987

Related U.S. Application Data

[63] Continuation-in-part of Ser. No. 940,450, Dec. 10, 1986, abandoned.

[51] Int. Cl.[4] ..... E06B 3/68

[52] U.S. Cl. ..... 49/51; 49/141; 160/92

[58] Field of Search ..... 49/51, 50, 141, 64; 160/91, 92

[56] References Cited

U.S. PATENT DOCUMENTS

| | | | |
|---|---|---|---|
| 1,986,713 | 1/1935 | Clark | 49/95 X |
| 2,509,362 | 5/1950 | Miller | 49/141 |
| 2,616,498 | 11/1952 | Wisner et al. | 49/51 X |
| 2,955,815 | 10/1960 | Muhr | 49/64 |
| 3,113,355 | 12/1963 | Tracy et al. | 49/50 |
| 3,460,289 | 8/1969 | Toth | 49/50 |
| 4,416,084 | 11/1983 | Zen | 49/50 |
| 4,485,589 | 12/1984 | Rodriguez-Torres | 49/50 X |

*Primary Examiner*—Philip C. Kannan

*Attorney, Agent, or Firm*—Alvin S. Blum

[57] ABSTRACT

A window assembly controls ventilation and prevents passage through the window opening. Provides hardened steel horizontal bars spaced apart vertically a distance that prevents passage. The bars are welded to hardened steel frame members. The steel assembly is anchored in the wall by resistant anchoring elements. The bars may be secured in place by other means. Glazed aluminum vents have top rails that enclose the bars and pivot upon them. Aluminum frame members enclose the steel frame members and support operator means that rotate the vents on the bars to open and close the vents. The angle of opening may be limited to prevent the vent extending beyond the wall at walkways.

20 Claims, 17 Drawing Figures

SECURITY WINDOWS

This application is a continuation-in-part of co-pending application Ser. No. 940,450 filed Dec. 10, 1986, now abandoned.

This invention relates to windows and more particularly to windows of the awning type that provide the security of a barred window without the appearance of a barred window.

BACKGROUND OF THE INVENTION

Windows should be openable to provide ventilation, especially in warm weather. However, fear of intruders forces many households to lock their windows and use air conditioning when open windows could provide adequate cooling, especially at night. Awning windows are especially ineffective to lock out intruders when open, as the flimsy aluminum connections are easily broken away. Air conditioning a closed house when cool outside air is available wastes energy resources and money.

Furthermore, the closed house is a health hazard. It has been shown that young children of smokers suffer twice the respiratory illnesses as children of non-smokers. In certain regions, geologically generated radon gas penetrates houses. If not adequately vented, this radioactive gas deposits in the lungs of the occupants. It is estimated to be the second leading cause of lung cancer after tobacco in this country. However, because of fear of intruders, residents are reluctant to leave windows open. One solution to the problem is to install a grill of iron bars, "burglar bars", covering the window opening, leaving spaces too small for human passage. Another solution has been to install awning windows having a horizontal iron bar upper edge of each vent. This bar pivots in journalled side frames at each end. This device presents installation problems. Furthermore, the points at which the bar pivots in the side frames are very vulnerable.

Awning windows have distinct advantages over double or single hung windows in providing ventilation over a greater portion of the window area. Nevertheless, designers have often rejected them for entire buildings because in one location the open awning window projects hazardously into a walkway area. The public could enjoy the many benefits of awning windows if this problem could be overcome.

SUMMARY OF THE INVENTION

It is an object of the invention to provide a window having substantially the operation and appearance of an ordinary awning or louver type window while providing a securely barred window that prevents intrusion. It is a further object of the invention to provide a window for detention purposes that prevents egress while exhibiting substantially the performance and appearance of an ordinary awning type window. It is a further object to provide a window with horizontal "burglar bars" that are highly resistant to destruction and that are securely anchored to frame members and that are adapted for firmly anchoring in the wall surrounding the window opening and that are vertically spaced apart an amount that prevents the passage of an intruder therebetween. It is a further object to optionally provide a window as described above that can be retrofitted to an existing window opening.

It is a further object to provide a window as described above wherein the individual awning panes or vents each have a horizontal frame member that pivots on a burglar bar.

It is a further object that said frame member removably fastens pivotally to said burglar bar to facilitate installation and service.

It is a further object that said burglar bar be obscured from view by said member and its fastening to enhance the final appearance of the window in use.

It is a further object to optionally provide a friction reducing liner between said bar and said member to enhance the pivoting of said vent about said bar.

It is a further object to optionally provide said bars of composite composition to increase the difficulty of defeating their function.

It is a further object to optionally provide a means of egress through said window by control from the inside for emergency exit purposes.

It is a further object to optionally provide means for attaching screens, sun and rain shields, storm panels and the like to said window.

It is a further object of the invention to provide a barred window as described above with a frame additionally providing lintel functions for the window opening. It is a further object to optionally provide the above disclosed window wherein the bars are cast into a concrete window opening not using steel jambs.

In providing a barred window with bars close together, the vents are narrower than conventional vents, approximately 6 inches or less. When these are fully open i.e. 90° from the vertical, they project beyond the wall less than conventional vents. The invention provides means for further reducing this projection by limiting the angle to which the vent can be opened so that these special, angle-limited windows can be installed at walkways where they can be opened without extending beyond the wall or a trim piece framing the wall.

DETAILED DESCRIPTION OF PREFERRED EMBODIMENTS

Figure 3:
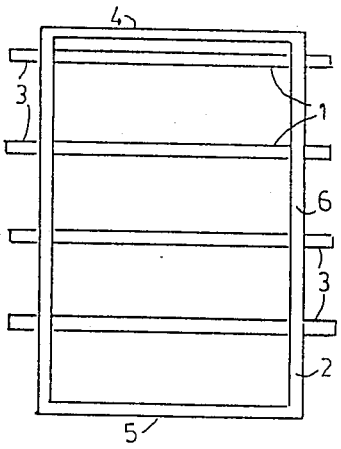
FIG. 3 is a front elevation of the steel burglar bars in a steel frame for installation by casting into a concrete window opening.

Referring first to FIG. 3, round, hardened steel bars 1 are held in rectangular frame 2 comprised of rectangular section hardened steel with holes cut for passage of the bars. The bars are welded where they pass through the frame. The bars are spaced sufficiently close together, less than six inches, to prevent passage of intruders. The ends 3 of the bars extending beyond the frame are adapted for securely fastening to the building such as by casting into the concrete surrounding the window opening. The steel frame 2 includes header 4, sill 5 and jambs 6.

The header 4 may be structured so as to serve as a lintel to support structures over the window in a manner well known in the art.

Figure 4:
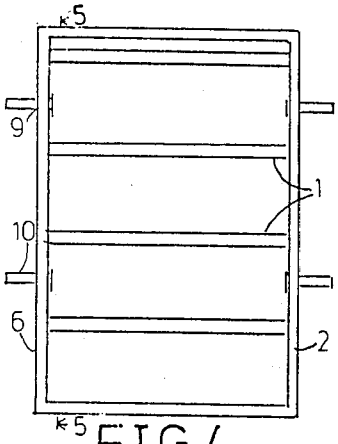
FIG. 4 is a front elevation of the steel burglar bars in a steel frame ready for retrofitting into a window opening.
Figure 5:
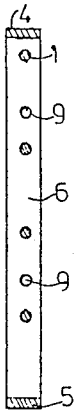
FIG. 5 is a vertical cross section taken on plane 5—5 of FIG. 4.
Figure 14:
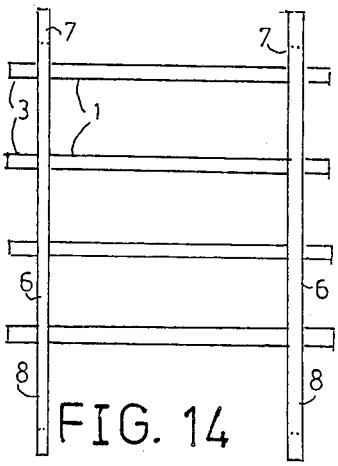
FIG. 14 is a steel bar and frame absent header and sill for embedding in a concrete opening.

In the alternative embodiment of FIG. 14, sill 5 and header 4 are absent from the frame and vertical projections 7 and 8 of jambs 6 extend above and below the frame to be embedded into the concrete along with bar ends 3 to effectively secure the bars. FIGS. 4 and 5 show a frame 2 with bars 1 that do not extend beyond the frame 2 at jambs 6. This embodiment is for insertions into an existing opening without extensive modification of the structure such as in retrofitting existing construction. The jambs are provided with holes 9. The frame 2 is positioned in the window opening. Horizontal holes are drilled through the holes 9 into the wall structure, and hardened steel pins 10 are cemented in place to sucurely hold the frame in place. The pins may be welded to the frame as well.

Figure 6:
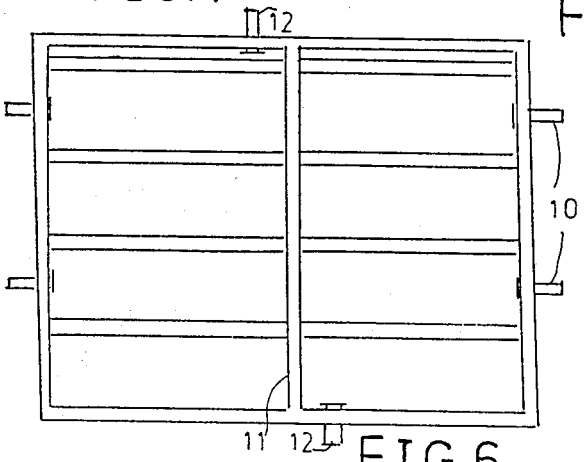
FIG. 6 is a front elevation of bars and frame of a wide window.
Figure 7:
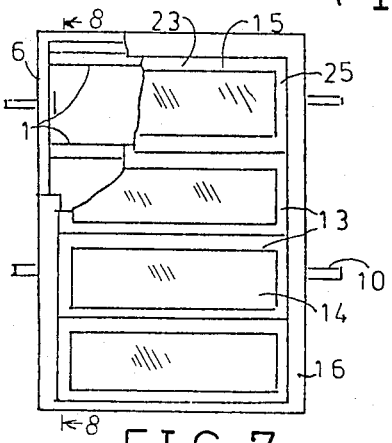
FIG. 7 is a front elevation of the bars and frame of FIG. 4 with aluminum frame cover and vents in place, partially broken away.
Figure 8:
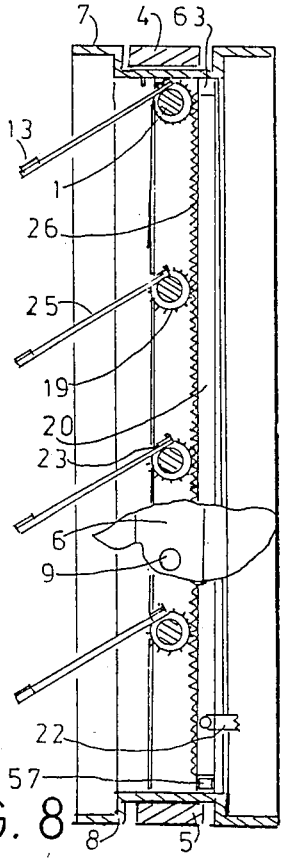
FIG. 8 is a vertical cross section taken on plane 8—8 of FIG. 7.

Alternatively, the jambs 6 may be fastened in place by clips, screws, and other securing means well known in the art. Alternatively, the jambs 6 may be secured in the wall by embedding in concrete or framing in place in a wooden structure. A wide window opening may use the frame of FIG. 6 which includes hardened steel mullion 11 and vertical securing pins 12 to prevent bending the longer bars and firmly anchor the frame. FIG. 7 shows the frame of FIG. 4 with the vents 13 in place. Each vent includes glass light 14 held in aluminum sash 15. The steel frame 2 is covered by aluminum jambs 16, header 7 and sill 8, which are shown partially broken away. The aluminum covering enhances apperance, resists corrosion and conceals security elements of steel. The steel may be further protected by coating with zinc, plastic or the like. FIG. 8 is a vertical section through the plane 8—8 of FIG. 7 that shows the vents 13 partially open. Pinion gears 19 are connected to the stiles (vertical sash elements) 25 of vents 13. The top rails 23 of vents 13 are rotatably connected to bars 1. All of the pinion gears 19 are engaged by the rack gear 26 along one edge of vertical drive rod 20. In a manner well known in the prior art, a crank operator, not shown, raises and lowers drive rod 20 in guide slot 63 by means of linkage 22 to close and open vents 13 by rotating them about the bars 1. Other vent drive means may include mechanisms well known in the art including pivoting links, worm gears and the like. Parallel operating mechanisms may operate simultaneously at both ends (stiles) of the vents.

Figure 2:
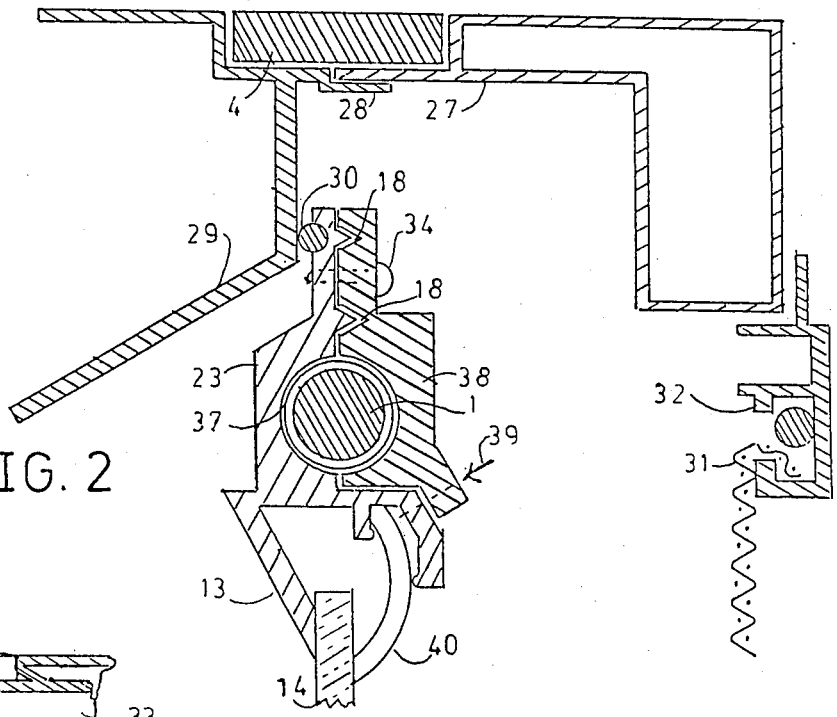
FIG. 2 is a vertical sectional detail of the upper window frame with a portion of the uppermost vent in place.
Figure 1:
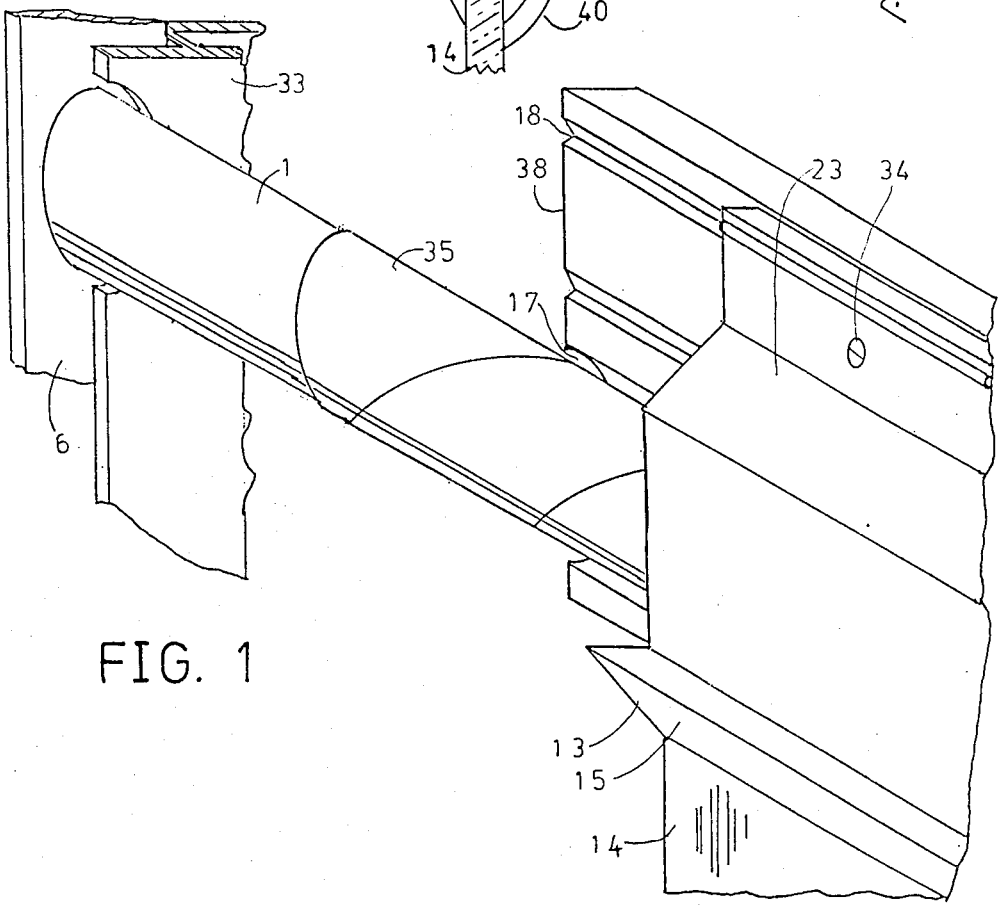
FIG. 1 is an isometric view of a portion of a jamb with bar and vent in place with portions broken away.

The novel structure of the vents 13 rotatably supported upon the burglar bars and concealing them from view is shown in the detail of FIGS. 1 and 2. FIG. 2 is a vertical cross section through the upper portion of the window frame and the vent not shown. FIG. 1 shows a portion of the steel jamb 6 at its connection to the bar 1 and the vent 13 with portions broken away. The frame header in FIG. 2 includes the steel frame header 4 covered by the aluminum header exterior portion 7 and interior portion 27 which overlap and may be joined together by cementing, for example, at overlap 28. Weather protecting overhang 29 provides a sealing surface for weatherstrip 30 carried by the vent 13. This member may optionally carry a retaining slot for storm panels and the like. Screen 31 in screen frame 32 is conventionally supported by frame member 27. The horizontal cylindrical steel bar 1 is welded to the vertical steel frame member 6. The steel member 6 is covered by interior aluminum jamb member 33 and overlapping exterior aluminum jamb member 16, shown in FIG. 9. Vinyl, wood or other suitable materials may be substituted for the aluminum. A thin, lubricous, resilient sleeve of nylon, polypropylene or the like, covers bar 1. It is spirally slit at 36 to enable it to be applied to the bar, that is welded at both ends, by simply winding it on. After the sleeves 35 are applied to the bars 1, each vent 13 is installed. The top rail 23 of the sash of each vent has a half-cylinder groove 37 to fit over the sleeve 36. A locking rail 38 with a corresponding half-cylinder groove 17 is secured to top rail 23 to form a cylindrical bearing about the sleeve to permit the vent to rotate about the bar with the sleeve providing the necessary lubrication and smoothness of motion. Locking grooves 18 and screws 34 secure the locking bar 38 to the top rail 23. Additional screws may optionally be located at arrow 39.

Figure 11:
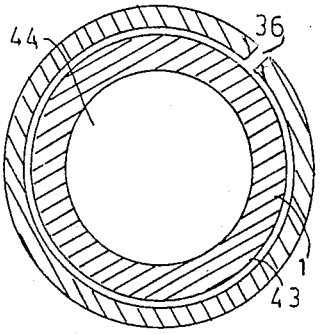
FIG. 11 is a vertical sectional detail of a burglar bar with sleeve.
Figure 12:
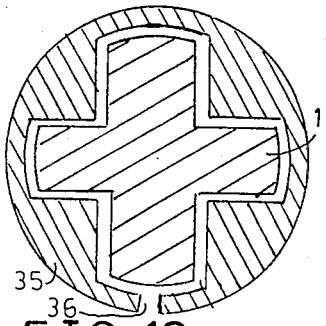
FIG. 12 is a vertical sectional detail of another burglar bar with sleeve.
Figure 9:
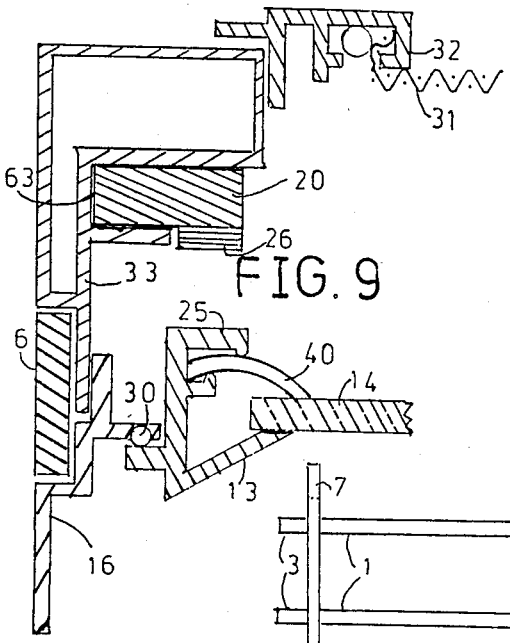
FIG. 9 is a horizontal sectional detail of the vertical jamb of the window with a portion of the vent in place.
Figure 10:
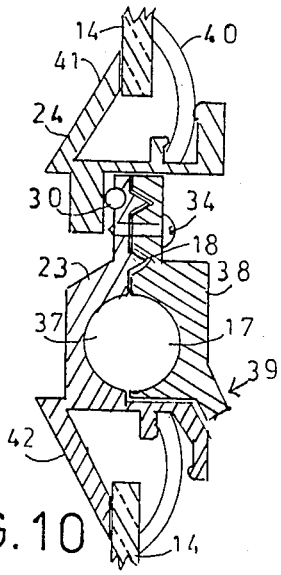
FIG. 10 is a vertical sectional detail of the juncture of two horizontal sash members.

The glass lights 14 are held in the sash 15 by spring glazing clips 40 well known in the art. FIG. 10 shows in partial section a detail of portions of two vents in closed position. The lower rail 24 of the upper vent 41 and the upper 30 to seal out the weather in a conventional fashion. FIG. 9 shows one vent in closed position at the jamb. The weatherstrip 30 carried in the aluminum jamb 16 is compressed by the stile 25 of the vent. The bars may be of a non-round cross section as shown in FIG. 12 to present more hardened surface to better resist cutting or bending. The sleeve 35 presents a round outer surface to the sash as a bearing. Alternatively, as shown in FIG. 11, the bar may be of composite structure. The outer portion 43 may be a case hardened steel or a vitreous coating to resist cutting, or the center 44 may be hollow or of a different composition such as a hard silicon carbide rod or a material that will fill the teeth of a saw to resist cutting.

Figure 13:
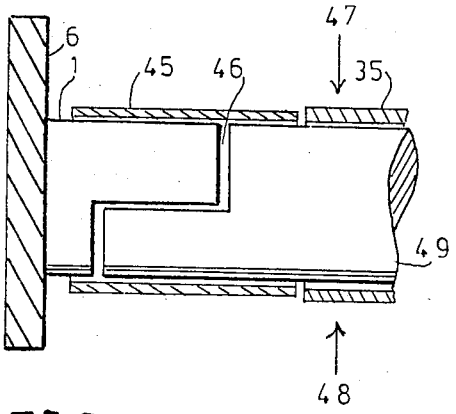
FIG. 13 is a plan view of a portion of a bar and frame with emergency break away features.

In certain application, it is necessary to provide a security window that can be broken open from inside without tools in an emergency. FIG. 13 shows an embodiment of the invention with a bar modified for that purpose. The bar 1 is cut through with a notch cut 46 at each end, leaving a free center portion 49. Thin sleeves 45 of frangible material are placed over the center portion 49, the center portion is then positioned as shown and the sleeves slipped across the cuts to hold the center portion at each end. The helically cut bearing sleeve 35 is then wound into place, holding sleeves 45 in position. When the vent is locked into position over the sleeves, the assembly is firmly secured and operational. When the vent is struck from the outside (arrow 48), the inner bar 49 impinges upon the outer bars 1 at notch 46, the sash and the sleeves are not stressed and they remain intact. When a strong blow is struck from inside (arrow 47), all of the force is applied to the sleeve 45 and the aluminum locking bar and screws (FIG. 1) which break away, permitting egress in an emergency. The notch may include a dovetail joint to resist forces from top and bottom as well. The outward appearance of the break away window may be indistinguishable from the other windows in appearance.

Figure 15:
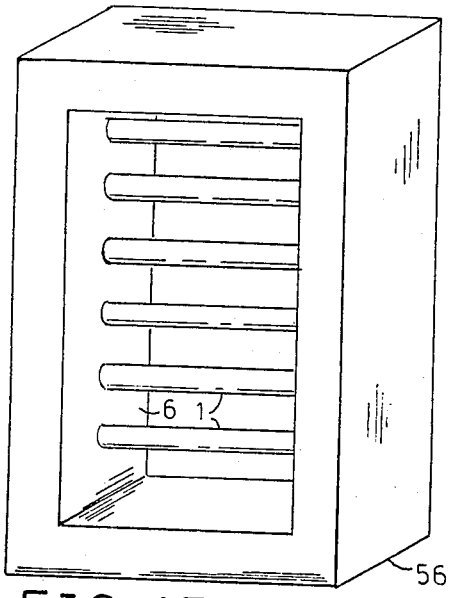
FIG. 15 is a perspective view of a cast concrete window frame holding bars embedded in the concrete.
Figure 16:
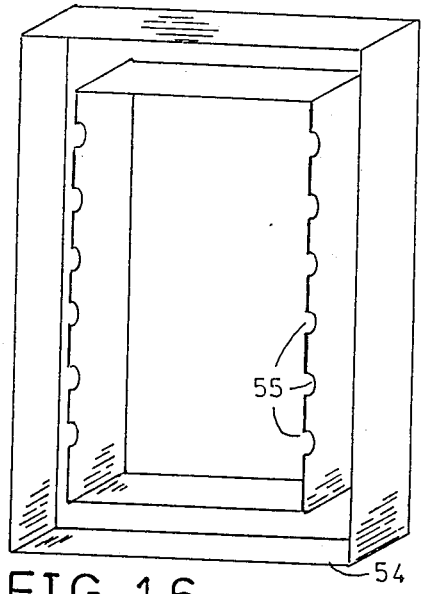
FIG. 16 is a perspective view of one side of a form for casting the frame of FIG. 15.

In the embodiment shown in FIG. 15, the bars 1 are cast in place in the cast concrete window frame 56. No special jamb is then necessary to hold or position the bars. This frame may also serve as a lintel. FIG. 16 shows a concrete form 54 with slots 65 for holding the bars 1 in position while the concrete is cast. This form 54 would be closed by a matching form of similar shape to contain the bars and concrete during casting.

Figure 17:
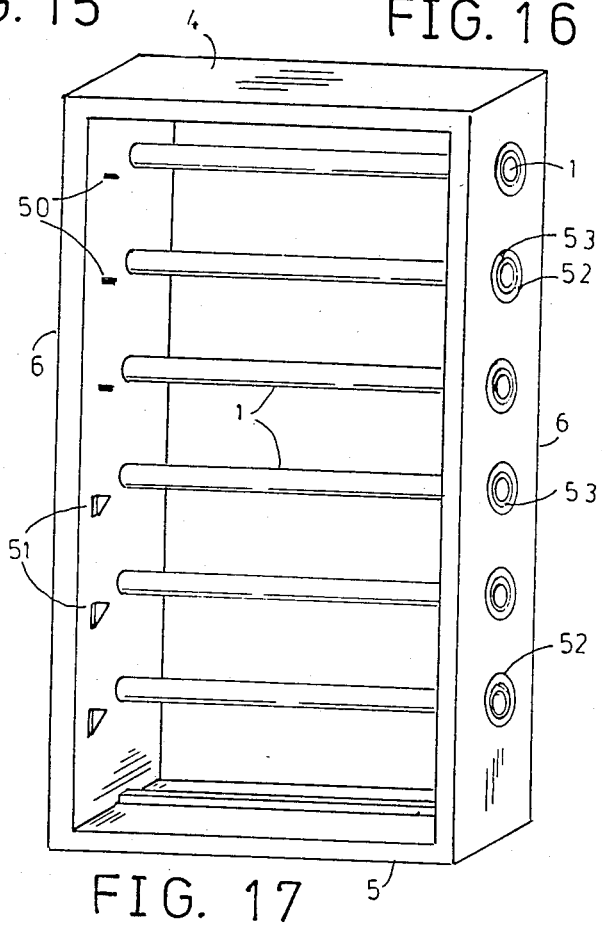
FIG. 17 is a perspective view of another embodiment of the invention with the bars embedded in the finished frame and providing angle limiting means.

In an alternative embodiment shown in FIG. 17, the bars 1 are held secured in finished frame 2, not requiring the covering pieces 16, and 33 of FIG. 9. The frame 2 may be of steel, wood, aluminum or plastic. The frame may be formed of profile extrusions incorporating the functions of vertical covering elements 16, 33 (FIG. 9) and horizontal elements 4 and 27 (FIG. 4) and the bars may be secured directly to the vertical jambs 6 by cementing, or by a large washer 52 held in place by a nut 53 or other well known securing means. This embodiment provides less security than aluminum covered steel jamb but it offers more security than current windows. Pins 50 or wedges 51 may be fastened to jamb 6 to limit the angle to which the vents 13 may be opened in those installations where the window must not extend beyond the wall and into the walkway. Alternatively, a block 57 may restrict the downward motion of control rod 20 (FIG. 8) to the angle of opening of vents 13

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A security window assembly combining the appearance and function of an awning window with horizontal, pivoting vents in a frame with the security of embedded, burglar resistant bars across an opening in a wall, including:

a plurality of horizontal security bars vertically spaced apart sufficiently close to prevent passage of intruders therebetween, said bars constructed of material resistant to damage by said intruders;

vertical side frame members horizontally spaced apart to fit within said window opening;

rigid permanent connection, by connecting means, between each said bar and each said side frame member;

said frame members having securing means for rigidly securing said frame members and said bars within said opening;

a plurality of awning-type vent means with top rails including bar connecting means, said bar connecting means enclosing said bar and rotatably connecting the top of said vent means to said bar, said vent means rotating about said bar for opening and closing and said bar functioning as an axle with said connecting means functioning as a bearing around said axle;

and vent opening and closing means supported by said frame and connected to each of said vent means the rotating said vent means about said bars to open and close said vent means.

2. The window assembly of claim 1, said securing means comprising the ends of said bars extending beyond said frame members and into said wall.

3. In the windows assembly of claim 1, said securing means comprising holes in said frame members adapted for receiving securing pins.

4. In the window assembly of claim 1, said vertical side frame members extending above and below said window opening to provide additional securing means for securing in said wall.

5. In the window assembly of claim 1, said vertical side frame members rigidly and securely fastened to header and sill horizontal frame members to form a substantially rectangular frame.

6. The window assembly of claim 5, including intermediate vertical mullion means rigidly connected to said bars and said header and sill frame members.

7. The window assembly of claim 1, including intermediate vertical mullion means rigidly connected to said bars.

8. The window assembly of claim 1, further including lubricous sleeve means covering each said bar and beneath said bar connecting means of said top rail, said sleeve means providing a bearing surface upon which said top rail rotates.

9. In the window assembly of claim 7, said bars having non-circular cross section and said sleeve means having a corresponding mating inner surface and a circular cross section outer surface.

10. In the window assembly of claim 1, said bars constructed of hardened steel.

11. In the window assembly of claim 1, said bars having a circular cross section.

12. In the window assembly of claim 1, said bars comprised of at least two different materials to better prevent damage thereto by said intruders.

13. In the window assembly of claim 1, said bars having a hollow center.

14. In the window assembly of claim 1, said frame further supporting screens, storm panels, sun shades and the like.

15. In the window assembly of claim 1, said bars further including directional breakaway means for breaking away said bars and said vent means from the inside by vigorous blows to provide emergency egress and for resisting equally vigorous blows from the outside.

16. In the window assembly of claim 15, said breakaway means including frangible sleeve means covering said bar at a directional joint means.

17. In the window assembly of claim 1, said frame comprising a first inner frame portion and a second outer frame portion, said inner frame portion and said outer frame portion joining together at a vertical plane substantially coplanar with a plane through said bars.

18. In the window assembly of claim 1, said vertical side frame members comprising the sides of a cast concrete window frame means in which said bars are embedded.

19. In the window assembly of claim 1, said vent opening and closing means including means for limiting the angle of opening of said vent means to prevent said vent means from extending beyond said wall in certain applications.

20. In the window assembly of claim 1, said vent means including glazing means for holding panes of glass and the like.

* * * * *

UNITED STATES PATENT AND TRADEMARK OFFICE

CERTIFICATE OF CORRECTION

PATENT NO. : 4,724,634

DATED : Feb. 16, 1988

INVENTOR(S) : Alvin S. Blum

It is certified that error appears in the above-identified patent and that said Letters Patent is hereby corrected as shown below:

Column 6,

In claim 1, line 28, delete "the" and substitute - - for - -.

In claim 3, line 1, delete "windows" and substitute - - window - -.

Signed and Sealed this

Twenty-second Day of June, 1993

Attest:

Michael K. Kirk

MICHAEL K. KIRK

Attesting Officer

Acting Commissioner of Patents and Trademarks